US006783193B2

(12) United States Patent
Yamaguchi et al.

(10) Patent No.: US 6,783,193 B2
(45) Date of Patent: Aug. 31, 2004

(54) ROTARY PUMP AND BRAKING APPARATUS USING ROTARY PUMP

(75) Inventors: Takahiro Yamaguchi, Kariya (JP); Takashi Satou, Okazaki (JP); Hiroyuki Shinkai, Obu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/279,996

(22) Filed: Oct. 25, 2002

(65) Prior Publication Data

US 2003/0080613 A1 May 1, 2003

(30) Foreign Application Priority Data

Oct. 29, 2001 (JP) ..... 2001-331003
Sep. 12, 2002 (JP) ..... 2002-266805

(51) Int. Cl.[7] ..... B60T 8/40
(52) U.S. Cl. ..... 303/116.4; 418/171; 277/361
(58) Field of Search ..... 303/116.4; 277/589, 277/399, 361; 418/129, 131, 133, 134, 136, 139, 140, 206.6, 125, 126, 112, 171, 55.4, 149, 190

(56) References Cited

U.S. PATENT DOCUMENTS 4,097,205 A * 6/1978 Miles ..... 418/61.1
5,108,275 A * 4/1992 Sager ..... 418/201.3
6,270,169 B1 * 8/2001 Harada et al. ..... 303/116.4
6,273,527 B1 8/2001 Yamaguchi et al.
6,474,752 B2 * 11/2002 Harada et al. ..... 303/116.4
6,592,191 B2 * 7/2003 Murayama et al. ..... 303/116.4

FOREIGN PATENT DOCUMENTS

JP H10-299668 11/1998

* cited by examiner

*Primary Examiner*—Robert A. Siconolfi
(74) *Attorney, Agent, or Firm*—Posz & Bethards, PLC

(57) ABSTRACT

A rotary pump such as a trochoid pump is composed of a housing and a rotating structure including an inner rotor and an outer rotor. The rotating structure is rotatably enclosed in a rotor space formed in the housing. The rotor space is divided into a low pressure space communicating with an inlet port and a high pressure space communicating with an outlet port by a pair of peripheral seals disposed in radial grooves formed in an inner periphery of the housing and by a side seal disposed in an axial space between the rotating structure and the housing. The side seal is disposed in the axial space not to cover sidewalls of the radial grooves belonging to the high pressure space, so that the side seal is bent by the pressure in the high pressure space to effectively seal the axial space.

8 Claims, 8 Drawing Sheets

ROTARY PUMP AND BRAKING APPARATUS USING ROTARY PUMP

CROSS-REFERENCE TO RELATED APPLICATIONS

This application is based upon and claims benefit of priority of Japanese Patent Applications No. 2001-331003 filed on Oct. 29, 2001 and No. 2002-266805 filed on Sep. 12, 2002, the contents of which are incorporated herein by reference.

BACKGROUND OF THE INVENTION

1. Field of the Invention

The present invention relates to a rotary pump such as a trochoid pump for pressurizing fluid therein, and to a braking apparatus for use in an automotive vehicle in which the rotary pump is used.

2. Description of Related Art

A rotary pump such as a trochoid pump having contacting gear teeth is composed of an inner rotor having outer teeth formed on its outer periphery, an outer rotor having inner teeth formed on its inner periphery, and a casing for containing the inner rotor and the outer rotor therein. The inner rotor and the outer rotor are disposed in the casing so that the outer teeth and the inner teeth engage with each other to form tooth spaces therebetween. The casing is composed of a pair of side plates covering axial surfaces of the inner rotor and the outer rotor, and a center plate covering a radial outer periphery of the outer rotor.

A rotational center of the outer rotor is positioned in a eccentric relation to a rotational center of the inner rotor. The tooth spaces communicating with an inlet port from which fluid is sucked are formed at one side of a centerline connecting both rotational centers. The tooth spaces communicating with an outlet port from which compressed fluid is discharged are formed at the other side of the centerline. The outlet port and the inlet port are formed in the casing. The inner rotor is rotated by a driving shaft connected thereto, and the outer rotor is rotated in the same direction by engagement of the outer teeth of the inner rotor with the inner teeth of the outer rotor. The tooth spaces formed between the outer teeth and the inner teeth vary according to rotation of both rotors, and thereby the fluid such as a braking fluid is sucked into the tooth spaces communicating with the inlet port and pressurized fluid is discharged from the tooth spaces communicating with the outlet port.

Since the inner rotor and the outer rotor rotate in the casing, pumping efficiency is adversely affected if friction between the axial surfaces of both rotors and the casing is high. Therefore, small spaces are provided between the axial surfaces of the rotors and the casing. That is, a thickness of rotors in their axial direction is made a little smaller than an axial height of the inner space of the casing. For this purpose, a thickness of the center plate is made a litter larger than the thickness of both rotors. An example of the rotary pump is shown in JP-A-2000-355274.

In the rotary pump disclosed in JP-A-2000-355274, a side seal 100 is disposed on an axial surface of the inner rotor and the outer rotor. The side seal 100 is provided to divide the inner space between the axial surface of the rotors and the casing into a low pressure space and a high pressure space. For this purpose, the side seal 100 is disposed to fully cover axial ends of a pair of peripheral seals 80 and 81 which seal a circular gap between an outer periphery of the outer rotor and an inner periphery of the casing. That is, the side seal 100 fully covers both sidewalls of each radial groove 73*d*, 73*e* in which the peripheral seal is disposed.

A relevant portion of the sealing structure in the rotary pump disclosed in JP-A-2000-355274 is shown in FIG. 11 attached to this application. A portion where a height difference exists between a seal member 80*b* (including a center plate 73) and an outer rotor 51 is sealed by the side seal 100. However, since the side seal 100 covers both sidewalls of the radial groove 73*d*, 73*e* and is supported by both sidewalls, the side seal 100 is not easily bent in the axial direction. Accordingly, a large gap 99 is formed between the side seal 100 and the outer rotor 51 as shown in FIG. 11. The fluid in the high pressure space flows into the low pressure space through the large gap 99, and therefore sealing between the low pressure space and the high pressure space becomes insufficient, resulting in decrease of the pump efficiency.

SUMMARY OF THE INVENTION

The present invention has been made in view of the above-mentioned problem, and an object of the present is to provide an improved rotary pump in which a side seal disposed on an axial surface of an inner rotor and an outer rotor performs a good sealing function. Another object of the present invention is to provide a braking apparatus in which the improved rotary pump is used.

A rotary pump such as a trochoid pump is composed of an inner rotor and an outer rotor, and a housing for enclosing both rotors therein. The inner rotor has outer teeth engaging with inner teeth of the outer rotor, and both rotors are rotatably housed in a rotor chamber formed in the housing. The outer rotor disposed in the rotor chamber in a eccentric relation to the inner rotor is rotated according to rotation of the inner rotor which is rotated by a driving shaft connected thereto. Capacities in plural tooth spaces formed between the outer teeth and the inner teeth change according to the rotation of both rotors.

The housing includes an inlet port through which fluid such as brake fluid is introduced and an outlet port through which the pressurized fluid is discharged. A pair of peripheral seals and a side seal are disposed in the housing to separate the rotor chamber into a low pressure space communicating with the inlet port and a high pressure space communicating with the outlet port.

The pair of the peripheral seals are disposed in radial grooves formed on an inner periphery of the housing to seal a circular gap between the inner periphery of the housing and an outer periphery of the outer rotor. The pair of peripheral seals slidably contact the outer periphery of the outer rotor and divide the circular gap into the low pressure space and the high pressure space. A part of the circular gap confined between the pair of peripheral seals constitutes a part of the lower pressure space communicating with the inlet port. The other part of the circular gap constitutes a part of the high pressure space communicating with the outlet port.

The side seal is disposed in an axial space formed between an axial surface of both rotors and an axial surface of the housing to divide the axial space into the low pressure space and the high pressure space. The side seal is ring-shaped and disposed in an annular groove formed on the axial surface of the housing facing the axial surface of the rotors. The side seal covers at least both axial ends of the peripheral seals, a tooth space forming a first closure portion, and a tooth space forming a second closure portion. Communication between closure portions and both of the inlet and outlet ports is interrupted. A ring-shaped rubber member may be disposed in the annular groove to push the side seal toward the axial surface of the rotors and to thereby establish a closer contact between the side seal and the axial surface of the rotors. A pair of side seals may be used to seal the axial spaces formed at both sides of the rotors.

The side seal covering the axial ends of the peripheral seals is disposed not to cover sidewalls of the radial grooves belonging to the high pressure space. In other words, the side seal is disposed not to be supported by the sidewalls belonging to the high pressure space. Accordingly, the side seal is easily bent by the high pressure communicating with the outlet port, and thereby the side seal closely contacts the axial surface of the rotors to establish a close sealing. The low pressure space and the high pressure space in the rotary pump are effectively separated from each other by the side seal formed and disposed according to the present invention, and thereby efficiency of the rotary pump is increased.

The rotary pump according to the present invention may be used in a braking apparatus for an automotive vehicle. The rotary pump generates a brake fluid pressure in wheel cylinders, which is hither than the pressure generated according to a brake pedal operation by a driver.

Other objects and features of the present invention will become more readily apparent from a better understanding of the preferred embodiment described below with reference to the following drawings.

DETAILED DESCRIPTION OF THE PREFERRED EMBODIMENT

Figure 1:
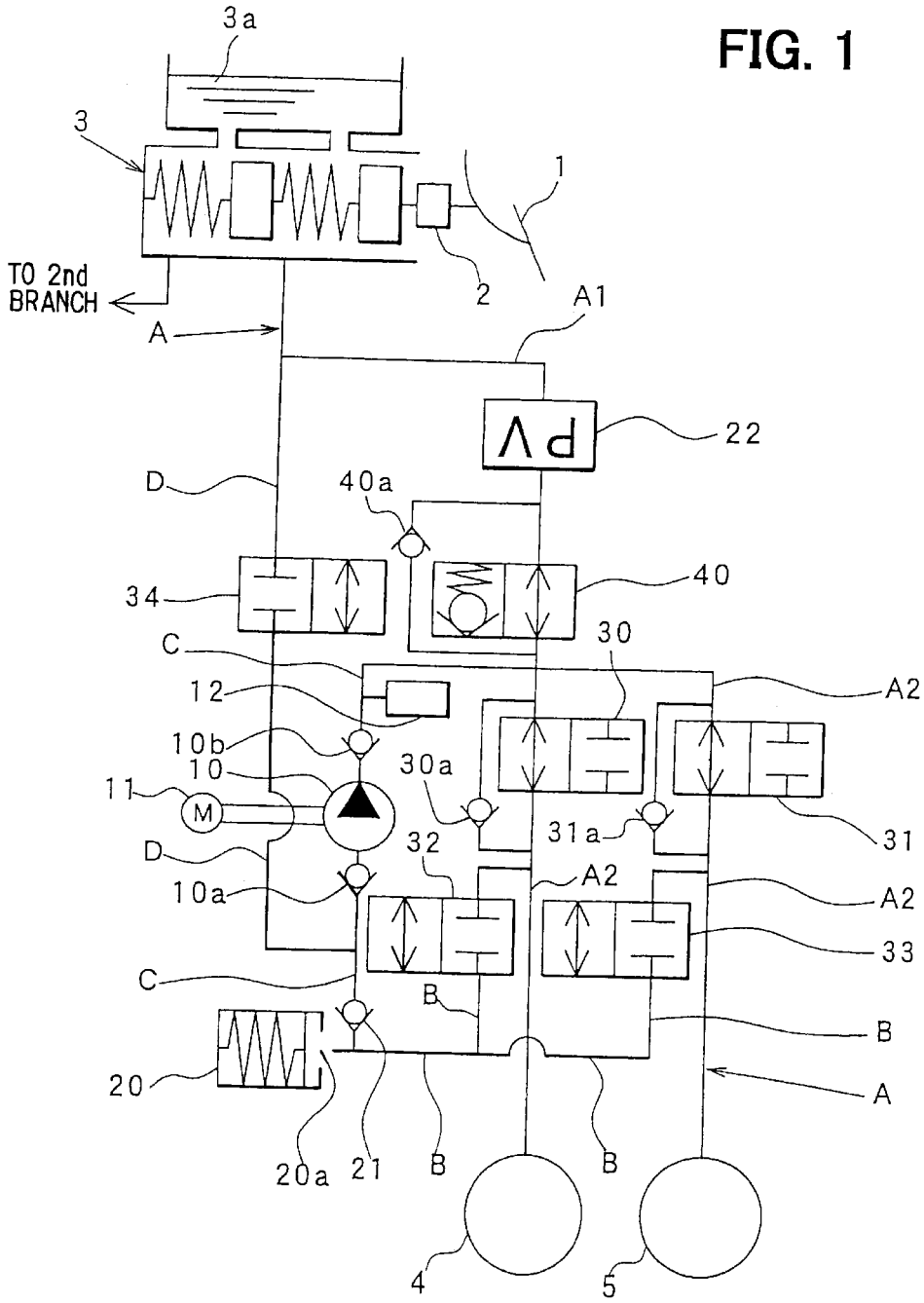
FIG. 1 is a block diagram showing a braking apparatus for an automobile in which a rotary pump is used.

A preferred embodiment of the present invention will be described with reference to accompanying drawings. First, referring to FIG. 1, a braking apparatus for use in an automotive vehicle, in which a rotary pump according to the present invention is used, will be described. In this braking apparatus, a trochiod pump as a rotary pump is used. The braking apparatus is designed for used in a front-wheel-driven vehicle. A front-right wheel (FR wheel) and a rear-left wheel (RL wheel) are connected in a first conduit branch, while a front-left wheel (FL wheel) and a rear-right wheel (RR wheel) are connected in a second conduit branch. This conduit arrangement is called an X-conduit arrangement. Only the first conduit branch is shown in FIG. 1 and is described in this specification because the second conduit branch has the same structure as the first conduit branch.

A braking force is applied to a brake pedal 1 by a driver. The brake pedal 1 is connected to a piston disposed in a master cylinder 3 via a servo unit 2 that amplifies the braking force applied to the brake pedal 1. A brake fluid pressure in the master cylinder 3 increases according to the braking force applied to the brake pedal 1. A master reservoir 3*a* for supplying the brake fluid to the master cylinder 3 and for reserving excessive brake fluid returned from the master cylinder 3 therein is connected to the master cylinder 3. The brake fluid pressurized in the master cylinder 3 is supplied to a wheel cylinder 4 of the FR wheel and a wheel cylinder 5 of the RL wheel via an anti-lock-braking system (referred to as ABS).

The brake fluid is supplied to both wheel cylinders 4, 5 through a main conduit A. The main conduit A is divided by a proportioning valve 22 connected in a reverse direction into a conduit A1 and a conduit A2. That is, the conduit A1 is connected between the master cylinder 3 and the proportioning valve 22. The brake fluid is supplied to both wheel cylinders 4, 5 through the respective conduits A2. The proportioning valve 22 usually transfers fluid pressure to its downstream side, attenuating a base pressure with a predetermined ratio, when it is connected in a forward direction. However, the proportioning valve 22 is connected in a reverse direction in this braking apparatus. Therefore, its downstream side, i.e., the conduit A2 side, becomes the base pressure. The conduit A2 is branched out at a downstream side of a control valve 40 to two conduits A2. One is connected to the FR wheel cylinder 4 through a pressurizing control valve 30, and the other is connected to the RL wheel cylinder 5 through a pressurizing control valve 31.

Both pressurizing control valves 30, 31 are two-position valves which are opened or closed under control of the ABS. When the pressurizing control valves 30, 31 are opened, brake fluid is supplied to the wheel cylinders 4, 5 from the master cylinder 3 or from a rotary pump 10. Under a normal braking condition where the ABS control is not performed, both pressurizing control valves 30, 31 are opened. A safety valve 30*a* is connected in parallel to the pressurizing control valve 30, and a safety valve 31*a* is connected in parallel to the pressurizing control valve 31. Brake fluid in the wheel cylinders 4, 5 is discharged through the safety valves 30*a*, 31*a* when the ABS control is terminated by releasing the brake pedal 1.

A depressurizing control valve 32 is connected between the FR wheel cylinder 4 and a port 20*a* of a reservoir 20. The depressurizing control valve 32 and the port 20*a* are connected through a conduit B. Similarly, a depressurizing control valve 33 is connected between the RL wheel cylinder 5 and the reservoir port 20*a*. The depressurizing control valve 33 and the reservoir port 20*a* are connected through a conduit B. Both depressurizing control valves 32, 33 are opened or closed under the ABS control. Under a normal braking condition where the ABS does not operate, both depressurizing control valves 32, 33 are closed.

A conduit C is connected between a control valve 40 and the reservoir 20. A rotary pump 10 which is driven by a motor 11 is disposed in the conduit C. Safety valves 10*a*, 10*b* are connected to an inlet port and an outlet port of the rotary pump 10, respectively. The rotary pump 10 will be described later in detail. A damper 12 for smoothening pulsating fluid pressure discharged from the rotary pump 10 is connected at a downstream side of the rotary pump 10. An one-way valve 21 is connected between the safety valve 10*a* and the reservoir port 20*a*.

An auxiliary conduit D for connecting the master cylinder 3 to the reservoir 20 and for connecting the master cylinder 3 to the rotary pump 10 is also provided. The rotary pump 10 sucks the fluid in the master cylinder 3 and in the conduit A1 through the conduit D, and discharges the sucked fluid to the conduit A2. In this manner, the fluid pressure in the wheel cylinders 4, 5 is made higher than the fluid pressure in the master cylinder 3, and thereby the braking force applied to the wheel cylinders 4, 5 is enhanced. This enhancement of the braking force is performed under a brake-assisting control. A pressure difference between the master cylinder 3 and the wheel cylinders 4, 5 is maintained by the proportioning valve 22.

A control valve 34 is disposed in the auxiliary conduit D. The control valve 34 is kept closed under the normal braking and the ABS control, and is opened when the brake-assisting control or a traction control is in operation. The one-way valve 21 is disposed between a junction, where the auxiliary conduit D is connected to the conduit C, and the reservoir 20 to prevent the fluid in the auxiliary conduit D from flowing into the reservoir 20.

The control valve 40 is a two-position valve which is usually kept open. The control valve 40 is closed when a high braking pressure is applied to the wheel cylinders under a situation where a pressure in the master cylinder 3 is lower than a predetermined level, or when the traction control is performed. Thus, the pressure difference between the master cylinder 3 and the wheel cylinders 4, 5 is maintained. A one-way valve 40*a* is connected in parallel to the control valve 40. The proportioning valve 22 may be eliminated, and the function of the proportioning valve 22 may be integrated in the control valve 40.

Now, referring to FIGS. 2–10, a structure of the rotary pump 10 will be described in detail. The rotary pump 10 is composed of a casing 50, a rotating structure having an outer rotor 51 and an inner rotor 52, and other associated components. The outer rotor 51 and the inner rotor 52 are disposed in a rotor chamber 50*a* formed in the casing 50. The inner rotor 52 is rotated by a driving shaft 54 around its rotational center Y. The outer rotor 51 having its rotational center X, eccentric with the rotational center Y of the inner rotor 52, is rotated according to rotation of the inner rotor 52.

Inner teeth 51*a* are formed on an inner periphery of the outer rotor 51, and outer teeth 52*a* are formed on an outer periphery of the inner rotor 52. Plural tooth spaces 53 are formed between the inner teeth 51*a* and the outer teeth 52*a* by eccentric engagement thereof. The rotary pump 10 shown here as an embodiment of the present invention is a trochiod pump, in which pumping spaces are formed between the inner teeth 51*a* and the outer teeth 52*a* without using dividing members such as vanes or crescents.

Figure 3:
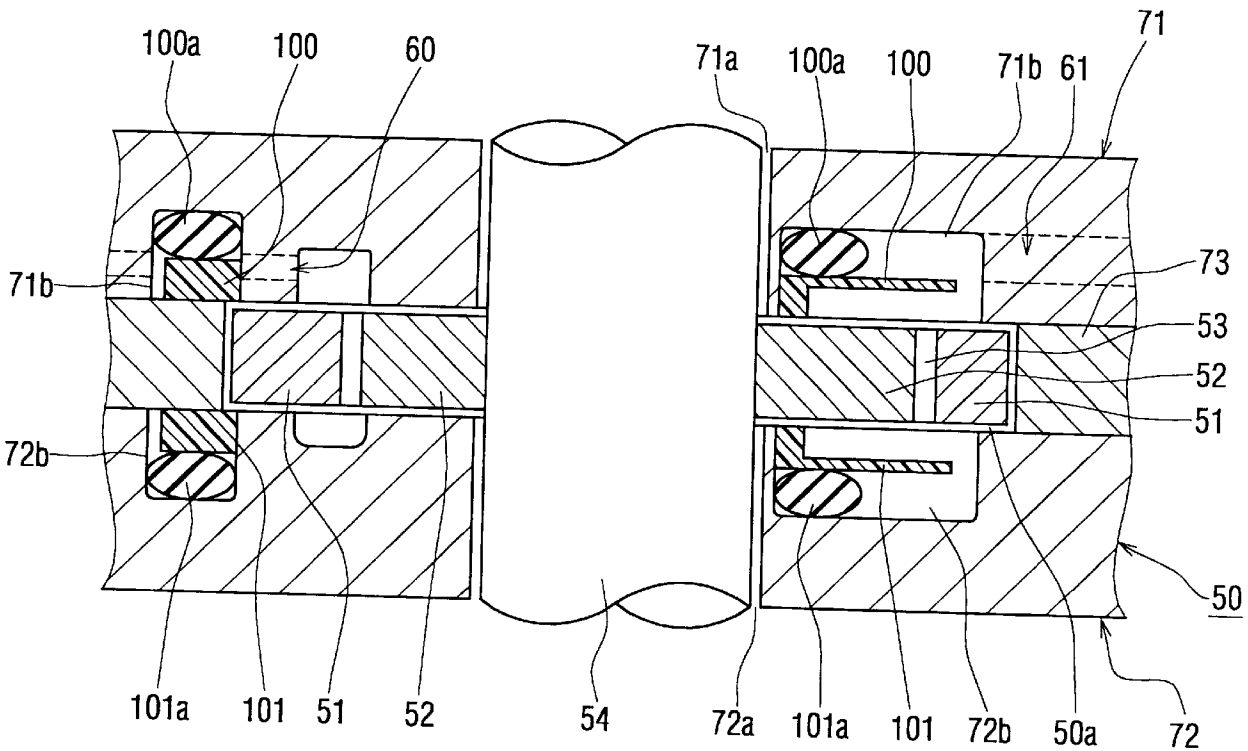
FIG. 3 is a cross-sectional view showing the rotary pump, taken along line III—III shown in FIG. 2.

As shown in FIG. 3, the housing 50 is composed of a pair of side plates (a first side plate 71 and a second side plate 72) and a center plate 73. The outer rotor 51 and the inner rotor 52 are sandwiched between the pair of side plates 71, 72 and are disposed in a center space of the center plate 73. The rotor chamber 50*a* is formed by the pair of side plates 71, 72 and the center plate 73. A center hole 71*a* and a center hole 72*a*, both communicating with the rotor chamber 50*a*, are formed in the first and the second side plates 71, 72, respectively. The driving shaft 54 connected to the inner rotor 52 is disposed through both center holes 71*a*, 72*a*. The outer rotor 51 and the inner rotor 52 are rotated in the rotor chamber 50*a* by the driving shaft 54.

Figure 2:
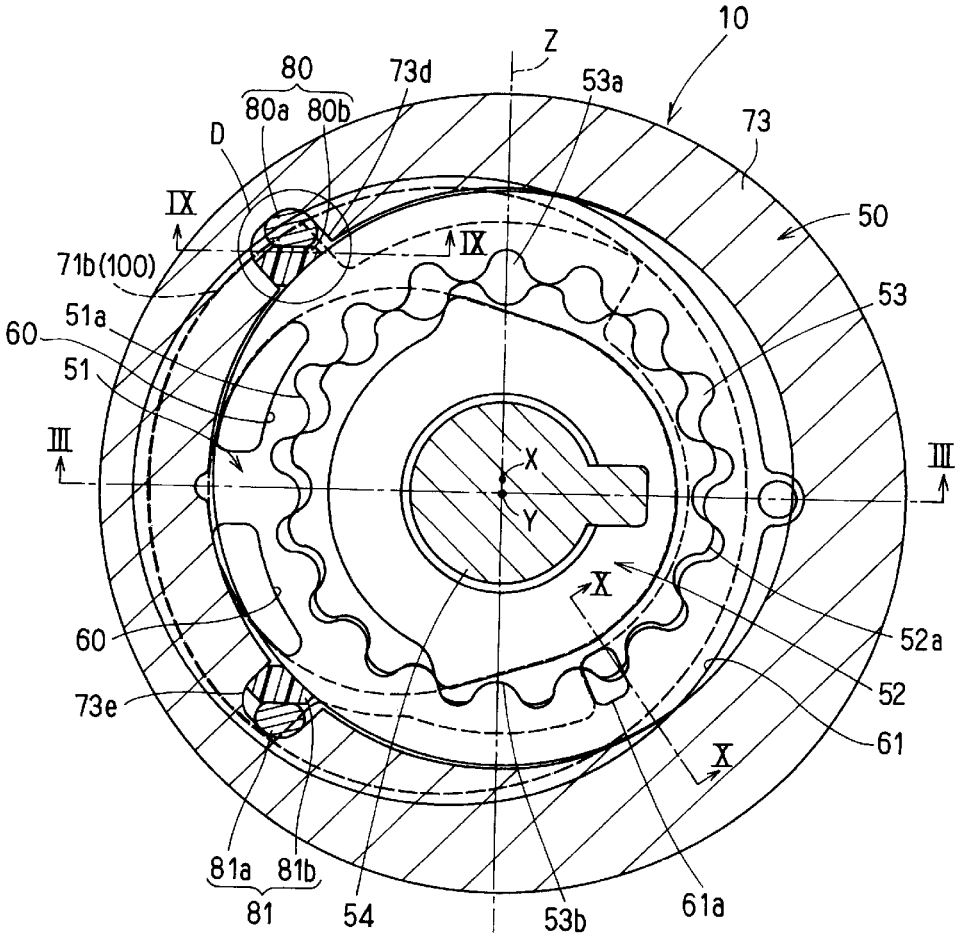
FIG. 2 is a cross-sectional view showing a rotary pump as an embodiment of the present invention.

As shown in FIGS. 2 and 3, an inlet port 60 through which the fluid is sucked into the rotor chamber 50*a* is formed in the first side plate 71 at the left side of a centerline Z passing through both rotational centers X and Y. An outlet port 61 through which the fluid pressurized in the rotor chamber 50*a* is discharged is formed in the first side plate 71 at a right side of the centerline Z. The fluid sucked from outside through the inlet port 60 is supplied to the tooth spaces 53 communicating with the inlet port 60, and the pressurized fluid is discharged through the outlet port 61 communicating with the tooth spaces 53.

Of plural tooth spaces 53, a first closure portion 53*a* forming the largest tooth space and a second closure portion 53*b* forming the smallest tooth space do not communicate with either the inlet port 60 or the outlet port 61. A pressure difference between the tooth spaces 53 communicating with the inlet ports 60 and the tooth spaces 53 communicating with the outlet port 61 is maintained by the first and the second closure portions 53*a*, 53*b*.

As shown in FIG. 2, a peripheral seal 80 is disposed on an inner periphery of the center plate 73 at an angular position rotated counter-clockwise by about 45° from the centerline Z around the rotational center X of the outer rotor 51. Similarly, another peripheral seal 81 is disposed at an angular position rotated clockwise by about 45° from the centerline Z around the rotational center X. The peripheral seal 80 composed of a rubber member 80*a* and a resin member 80*b* is disposed in a radial groove 73*d* formed on the inner periphery of the center plate 73. Similarly, the peripheral seal 81 composed of a rubber member 81*a* and a resin member 81*b* is disposed in a radial groove 73*e* formed on the inner periphery of the center plate 73. The resin members 80*b*, 81*b* disposed in both radial grooves 73*d*, 73*e* silidably contact an outer periphery of the outer rotor 51 to prevent the fluid from flowing through a circular gap between the inner periphery of the center plate 73 and the outer periphery of the outer rotor 51. The circular gap is divided into two portions by both peripheral seals 80, 81, i.e., a low pressure space communicating with the inlet port 60 and a high pressure space communicating with the outlet port 61.

The resin member 80*b* is rectangular-rod-shaped, and is biased toward the outer periphery of the outer rotor 51 by the ball-shaped or cylinder-shaped rubber member 80*a*. The resin member 80*b* is made of a resin material, such as PTFE, PTFE reinforced by carbon fibers or PTFE including graphite. A width of resin member 80*b*, (measured along the circular gap between the center plate 73 and the outer rotor 51) is made a little smaller than a width of the radial groove 73*d*, so that a small gap is formed between the radial groove 73*d* and the resin member 80*b* when resin member 80*b* is disposed in the radial groove 73*d*. Thus, the resin member 80*b* is pushed out toward the outer periphery of the outer rotor 51 by a pressure of the fluid entered into the radial grooves 73*d*, thereby establishing a good contact between the resin member 80*b* and the outer periphery of the outer rotor 51.

An axial length of the resin member 80*b*, (measured in a direction parallel to the axis of the driving shaft 54) is made a little longer than a thickness of the center plate 73. The resin member 80*b* is compressed in its axial direction by the pair of side plates 71, 72 when the side plates 71, 72 are assembled to the center plate 73. Thus, the axial length of the resin member 80*b* becomes equal to the thickness of the center plate 73 after the side plates 71, 72 and the center plate 73 are assembled together.

The other peripheral seal 81 including the resin member 81*b* and the rubber member 81*a*, and the radial groove 73*e* for accommodating the peripheral seal 81 therein are all the same as the peripheral seal 81 and the radial groove 73*d*. Therefore, the above-description of the peripheral seal 80 is similarly applied to the peripheral seal 81.

As shown in FIGS. 2 and 3, an annular groove 71*b* for accommodating a ring-shaped side seal 100 and a rubber member 100*a* therein is formed on an axial surface of the first side plate 71 facing the inner rotor 52 and the outer rotor 51. Similarly, an annular groove 72*b* for accommodating a ring-shaped side seal 101 and a rubber member 101*a* therein is formed on an axial surface of the second side plate 72 facing the inner rotor 52 and the outer rotor 51. Since the shape of both annular grooves 71*b* and the 72*b* is the same, the annular groove 72*b* formed on the axial surface of the second side plate 72 will be described below in detail with reference to FIG. 4.

Figure 4:
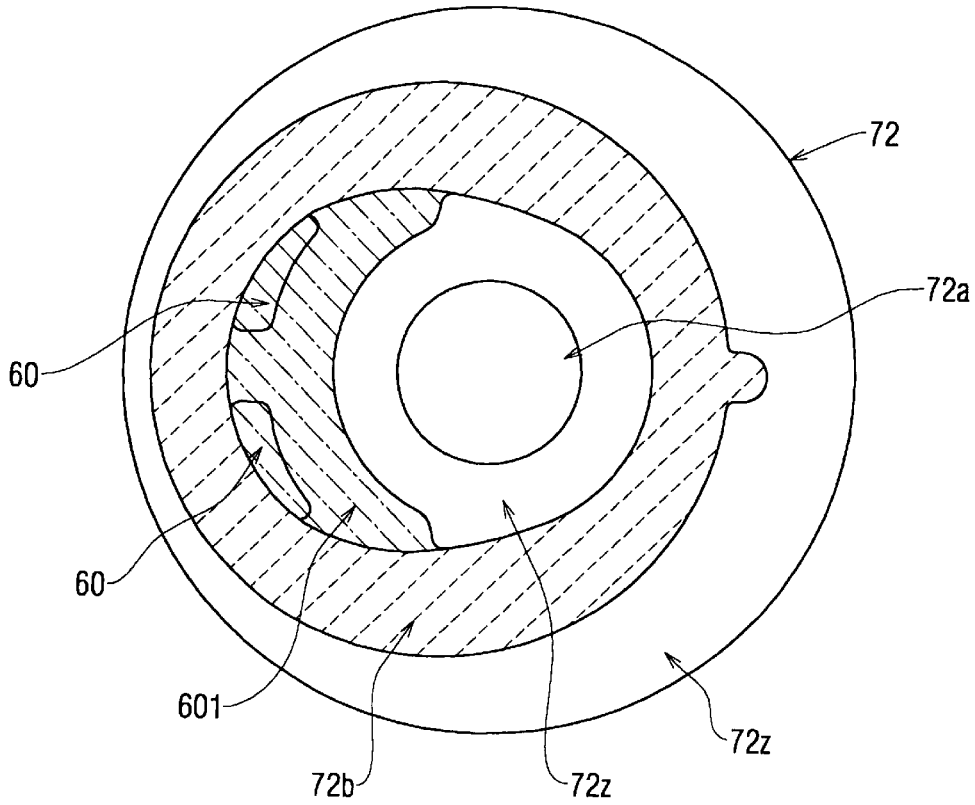
FIG. 4 is a plan view showing an annular groove formed on a side plate of the rotary pump.

In FIG. 4, a plan shape of the annular groove 72*b* is shown as an area hatched by dotted lines. The annular groove 72*b* is formed in an eccentric relation with respect to the center hole 72*a* of the second side plate 72. In other words, a center of the annular groove 72*b* is shifted toward the inlet port side. The annular groove 72*b* is formed to face, in a clock-wise order, a communicating hole 61*a* which communicates with the outlet port 61, the second closure portion 53*b*, the axial end of the peripheral seal 81, the axial end of the peripheral seal 80, and the first closure portion 53*a*.

The annular groove 72*b* (the area hatched by dotted lines in FIG. 4) is depressed from other area 72*z* which contacts the axial surface of the inner rotor 52 and the outer rotor 51. An area 601, hatched by chained lines, corresponding to the inlet port 60 and portions connecting the inlet port 60 to the tooth spaces 53 is further depressed from a bottom surface of the annular groove 72*b*.

Figure 5:
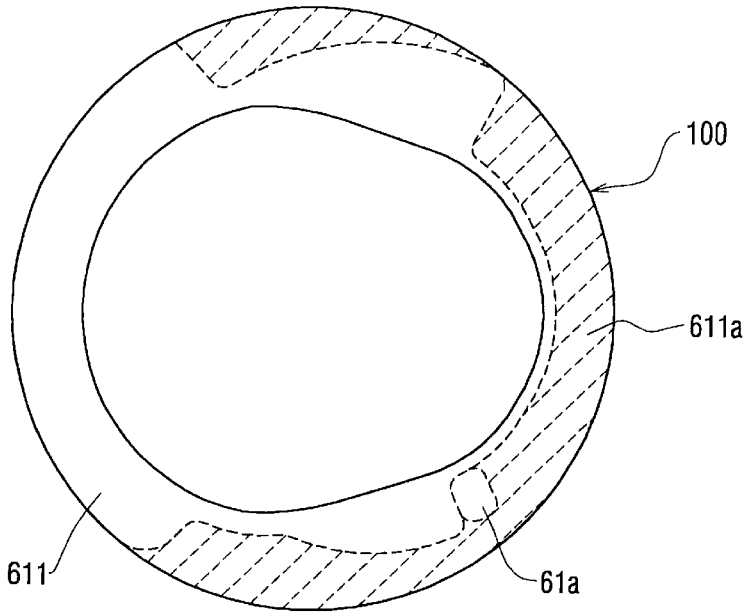
FIG. 5 is a plan view showing a ring-shaped side seal.

The ring-shaped side seals 100, 101 are disposed in the respective annular grooves 71*b*, 72*b*. The side seal 100 disposed in the annular groove 71*b* is shown in FIG. 5. Since the both side seals 100, 101 are the same, only the side seal 100 will be described in detail. A hatched portion 611*a* shown in FIG. 5 is made thinner than a portion 611, so that only the portion 611 contacts the axial surface of the inner rotor 52 and the outer rotor 51. A frictional loss between the side seal 100 and the rotors 51, 52 can be reduced by making the thin portion 611*a*. The portion 611 is referred to as a thick portion 611. The communication hole 61*a* communicating with the outlet port 61 is formed on the side seal 100. The side seal 100 is made of a resin material such as PEEK or PEEK including carbon, which is harder than the material forming the resin members 80*b*, 81*b* of the peripheral seals 80, 81.

Figure 6:
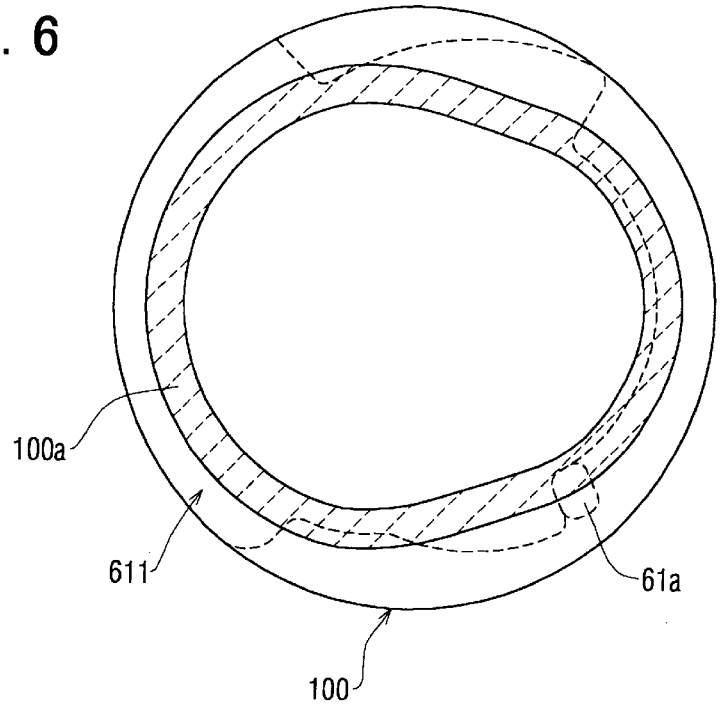
FIG. 6 is a plan view showing a ring-shaped rubber member.
Figure 7:
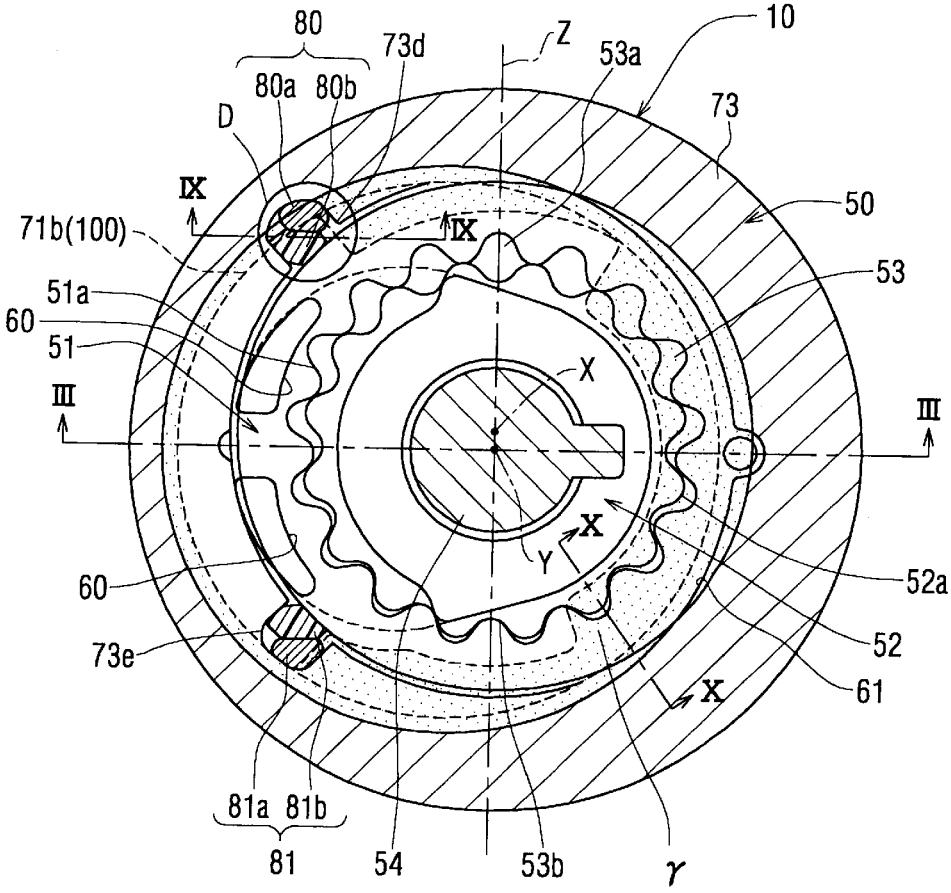
FIG. 7 is a cross-sectional view showing the rotary pump, in which a high pressure space is shown as a dotted area.

As shown in FIG. 3, rubber members 100*a*, 101*a* are disposed in the respective annular grooves 71*b*, 72*b* to push the respective side seals 100, 101 toward the axial surfaces of the inner rotor 52 and the outer rotor 51. Both rubber members 100*a*, 101*a* are the same, and a plan view of the rubber member 100*a* is shown in FIG. 6. The rubber member 100*a* placed on the side seal 100 is shown in FIG. 6. The rubber member 100*a* is ring-shaped and disposed in contact with an inner wall of the annular groove 71*b*, as shown in FIG. 3. A total length of the ring-shaped rubber member 100*a* is made shorter than the annular length of the inner wall of the annular groove 71*b*. When the rubber member 100*a* is disposed in the annular groove 71*b*, it is expanded to be disposed in contact with the inner wall. As shown in FIG. 6, the rubber member 100*a* is in contact with not only the thick portion 611 of the side seal 100 but also the thin portion 611*a* thereof. The thin portion 611*a* is formed to support the rubber member 100*a* thereon.

The inner space of the casing 50 including the rotor chamber 50*a* is divided into two spaces, a low pressure space communicating with the inlet port 60 and a high pressure space communicating with the outlet port 61, by the peripheral seals 80, 81, side seals 100, 101, and the first and the second closure portions 53*a*, 53*b*. The high pressure space is shown as a dotted area γ in FIG. 7. An area other than the dotted area γ is the low pressure area. Communication between the space around the driving shaft 54 and the outlet port 61 is interrupted by the side seals to separate the high pressure space from the low pressure space.

The side seals 100, 101 seal the first closure portion 53*a* and the second closure portion 53*b*, and further seal the low pressure space in the circular gap enclosed by the pair of peripheral seals 80, 81. Further, tooth spaces 53 communicating with the inlet port 60 have to be sealed by the side seals 100, 101 at the axial sides of the inner rotor 52 and the outer rotor 51. For this purpose, in the low pressure space between the pair of peripheral seals 80, 81, the side seals 100, 101 have to be extended up to the circular gap between the outer periphery of the outer rotor 51 and the inner periphery of the center plate 73.

Figure 8:
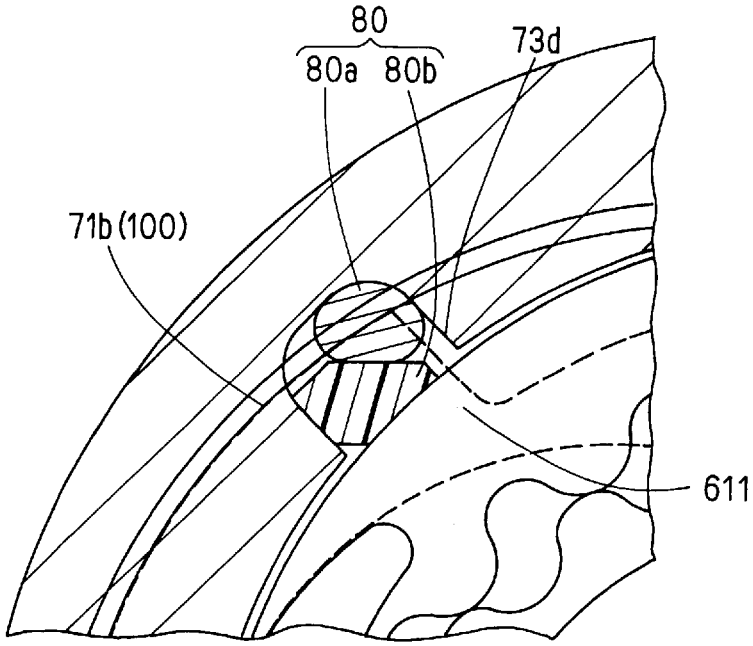
FIG. 8 is a cross-sectional view showing region D encircled in FIG. 2 in an enlarged scale.

The side seals 100, 101 cover the axial ends of the pair of the peripheral seals 80, 81 to separate the low pressure space communicating with the inlet port 60 from the high pressure space communicating with the outlet port 61. In other words, the low pressure space between the pair of peripheral seals 80, 81 is sealed by the peripheral seals 80, 81 in cooperation with the side seals 100, 101. The radial groove 73*d*, in which the peripheral seal 80 is disposed, covered by the side seal 100 is shown in FIG. 8, in an enlarged scale. The portion shown in FIG. 8 corresponds to a region D encircled in FIG. 2.

As shown in FIG. 8, the thick portion 611 does not completely cover the radial groove 73*d*. One sidewall of the radial groove 73*d* is left uncovered by the thick portion 611 of the side seal 100. A vicinity of the uncovered sidewall belongs to the high pressure space, while the covered portion of the radial groove 73*d* belongs to the low pressure space. The other radial groove 73*e* is covered by the side seal 100 in the same manner, so that one edge of the radial groove 73*e* belonging to the high pressure space is not covered by the side seal 100. The other side seal 101 is disposed in the same manner as the side seal 100.

Now, operation of the braking apparatus and the rotary pump 10 will be described. The control valve 34 (shown in FIG. 1), which is closed under a normal braking operation, is opened when a large braking force is required, e.g., when a braking force larger than a braking force corresponding to a force applied to the brake pedal 1 is required, or when the brake pedal 1 is deeply pressed down. When the control valve 34 is opened, the brake fluid at a high pressure generated in the master cylinder 3 is supplied to the rotary pump 10 through the conduit D.

On the other hand, the rotary pump 10 is driven by the motor 11. According to rotation of the inner rotor 52, the outer rotor 51 is rotated in the same direction. A capacity of each tooth space 53 formed between the inner teeth 51*a* of the outer rotor 51 and the outer teeth 52*a* of the inner rotor 52 is varied according to the rotation of the inner and the outer rotors 51, 52. The brake fluid is sucked from the inlet port 60, and the brake fluid pressurized in the rotary pump 10 is discharged from the outlet port 61 to the conduit A2 connected to the wheel cylinders 4, 5. The pressure in the wheel cylinders 4, 5 is increased by the fluid supplied from the rotary pump 10.

During the operation of the rotary pump 10, a pressure in the circular gap outside the outer rotor 51 at the inlet port side becomes an inlet port pressure. A pressure in the circular gap at the outlet port side becomes an outlet pressure. That is, the circular gap is divided into two spaces, a low pressure space communicating with the inlet port 60 and a high pressure space communicating with the outlet port 61. Also, in the axial gaps between the rotors 51, 52 and the pair of side plates 71, 72, the low pressure space and the high pressure space are formed. This is because the circular gap outside the outer rotor 51 is divided into the low pressure space and the high pressure space by the peripheral seals 80, 81, and the axial gaps and the first and the second closure portions 53*a*, 53*b* are sealed by the side seals 100, 101 to divide the axial gaps into the low pressure space and the high pressure space.

In sealing the axial gaps between rotors 51, 52 and the pair of side plates 71, 72, the side seals 100, 101 are arranged as shown in FIG. 8. That is, the side seals 100, 101 do not completely cover the peripheral seals 80, 81. The sidewalls of the radial grooves 73*d*, 73*e* belonging to the high pressure space are not covered by the side seals 100, 101. Because the side seals 100, 101 are arranged in this manner, the side seals 100, 101 are more easily bent by the outlet pressure so that the side seals 100, 101 closely contact the axial side surface of the outer rotor 51.

Figure 9:
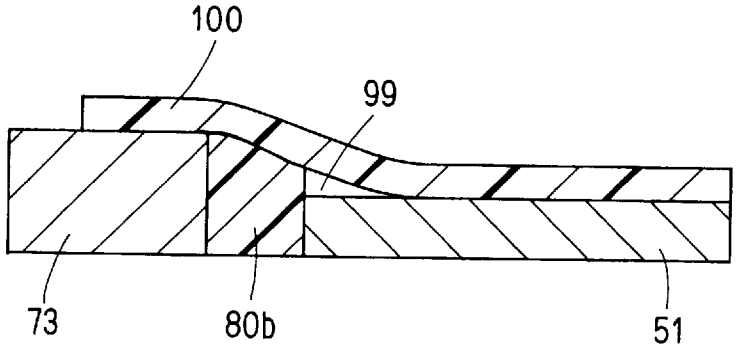
FIG. 9 is a cross-sectional view showing a part of a side seal contacting a resin member of a peripheral seal, taken along line IX—IX shown in FIG. 2.
Figure 11:
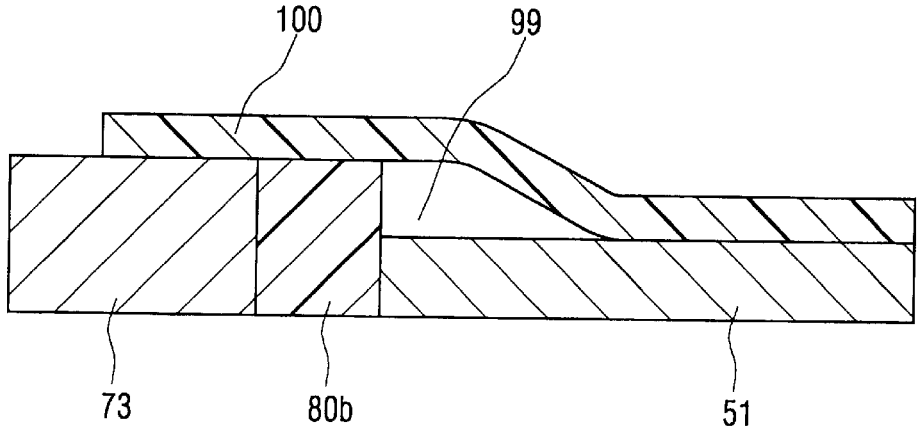
FIG. 11 PRIOR ART
FIG. 11 is a cross-sectional view showing a part of a side seal contacting a peripheral seal member in a conventional rotary pump.

More particularly, as shown in FIG. 9 (which is a cross-sectional view, taken along line IX—IX shown in FIG. 2, showing the side seal 100 at a vicinity of the resin member 80*b* in the radial groove 73*d*), a gap 99 between the outer rotor 51 and the side seal 100 becomes smaller, compared with the gap 99 formed in the conventional rotary pump shown in FIG. 11. Since the outer rotor 51 is thinner than the center plate 73 and the resin member 80*b*, it is not possible to completely eliminate the gap 99. In this embodiment, however, the side seals 100, 101 are arranged to be easily bent by the outlet pressure, thereby making the gap 99 smaller. Therefore, an amount of brake fluid leakage from the high pressure space to the low pressure space through the gap 99 is reduced.

The contact between the side seals 100, 101 and the axial surfaces of the rotors 51, 52 is realized by the rubber members 10*a*, 101*a* before the outlet pressure of the rotary pump 10 is established, i.e. at the beginning of the pumping operation. After the outlet pressure is established, the side seals 100, 101 are bent by the outlet pressure, and thereby the side seals 100, 101 further closely contact the axial surfaces of the rotors 51, 52. The side seals 100, 101 are bent by a pressure difference between the low pressure space and the high pressure space. The axial sides of the rotors are effectively sealed by the side seal structure according to the present invention from the beginning of the pumping operation throughout an entire range of the pumping operation.

Figure 10:
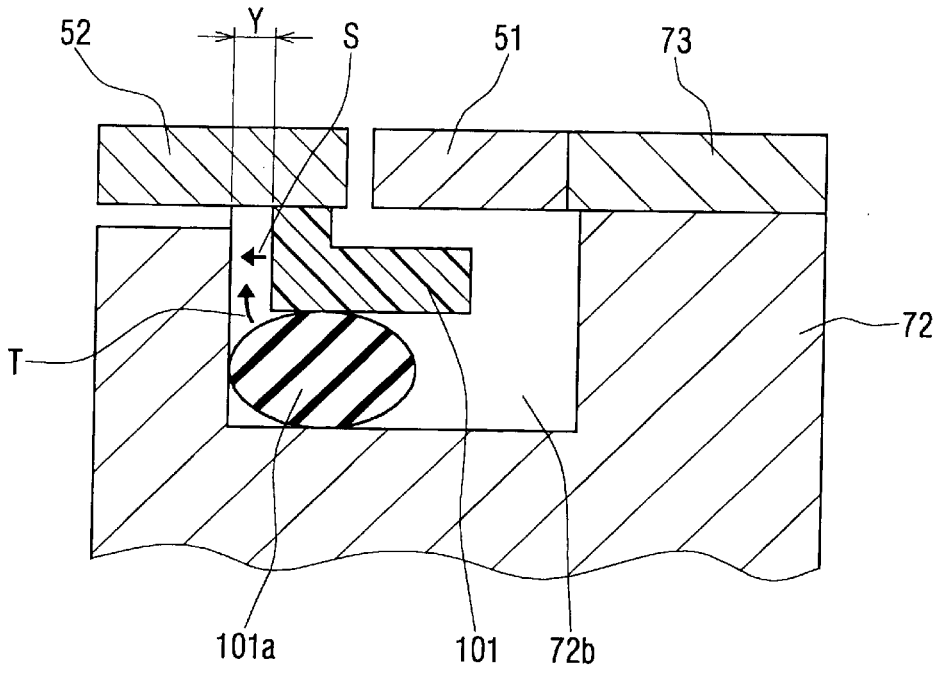
FIG. 10 is a cross-sectional view showing an annular groove formed on a side plate at a vicinity of an outlet port, taken along line X—X shown in FIG. 2.

The inside hole of the side seals 100, 101 may be made larger than a diametric size of the inner wall of the annular grooves 71*b*, 72*b*, so that the side seals 100, 101 are easily disposed in the annular grooves 71*b*, 72*b*. When the inside hole is made larger, a gap Y exists between the inner periphery of the side seal 101 and the inner wall of the annular groove 72*b*, as shown in FIG. 10. The rubber member 101*a* is pushed toward the gap Y by the outlet pressure (in a direction T), and thereby the rubber member 101*a* tends to enter into the gap Y. If the rubber member 101*a* partly enters into the gap Y, it may be damaged by the corner of the side seal 101. At the same time, however, the side seal 101 is also pushed toward the gap Y by the outlet pressure (in a direction S), thereby making the gap Y smaller. Therefore, the rubber member 101*a* is prevented from entering into the gap Y and from being damaged by the corner of the side seal 101. Though the above situation is described only as to the side seal 101, the same is equally applicable to the other side seal 100.

The present invention is not limited to the embodiment described above, but it may be variously modified. For example, though the annular grooves 71*b*, 72*b* are formed on both side plates 71, 72, it may not be necessary to form the annular grooves on both side plates. The annular groove may be made on either one of the side plates 71, 72. In this case, the side seal is disposed only on one side plate having the annular groove, and the other side plate is arranged to contact the axial surface of the rotors 51, 52 with a mechanical seal (a metallic seal). Though the rubber members 100*a*, 101*a* for pushing the side seals 100, 101 are used in the foregoing embodiment, the rubber members may be eliminated. In this case, the side seals are bent by the outlet pressure to establish the contact with the axial surfaces of the rotors 51, 52. Further, in this case, the thin portion 611*a* of the side seal shown in FIG. 5 may be eliminated.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A rotary pump comprising:

a rotating structure comprising an outer rotor having inner teeth formed on an inner periphery thereof and an inner rotor having outer teeth formed on an outer periphery thereof, the inner rotor being rotated by an driving shaft connected thereto, the outer rotor being disposed to be rotated in an eccentric relation with the inner rotor so that tooth spaces formed between the outer teeth and the inner teeth change according to rotation of the inner rotor and the outer rotor;

a casing having a center hole through which the driving shaft is inserted, an inlet port for introducing fluid into the tooth spaces, and an outlet port for discharging fluid pressurized in the tooth spaces, the casing forming an inner space for enclosing the rotating structure therein; and sealing means for dividing the inner space into a low pressure space communicating with the inlet port and a high pressure space communicating with the outlet port, wherein:

the sealing means comprises: a pair of peripheral seals disposed in radial grooves formed on an inner periphery of the casing, the pair of peripheral seals slidably contacting an outer periphery of the outer rotor to thereby divide a circular gap between the inner periphery of the casing and the outer periphery of the outer rotor into the low pressure space and the high pressure space; and a ring-shaped side seal disposed in an annular groove formed on an axial surface of the casing facing an axial surface of the rotating structure, the side seal overlapping the pair of peripheral seals to thereby divide an axial gap between the casing and the rotating structure into the low pressure space and the high pressure space;

the side seal forms a first closure portion and a second closure portion which divide the tooth spaces into a group of tooth spaces belonging to the low pressure space and another group of tooth spaces belonging to the high pressure space; and the side seal overlaps the pair of peripheral seals by covering sidewalls of the radial grooves belonging to the low pressure space without covering the other sidewalls belonging to the high pressure space.

2. The rotary pump as in claim 1, wherein:

the casing comprises a first side plate and a second side plate, each facing the axial surface of the rotating structure and having an outer diameter larger than an outer diameter of the outer rotor, and a center plate disposed between the first side plate and the second side plate for covering the outer diameter of the outer rotor, the center plate having a thickness larger than a thickness of the rotating structure.

3. The rotary pump as in claim 1, wherein:

the annular groove is formed on the axial surface of the casing in an eccentric relation with the center hole to face the first closure portion, the second closure portion, and the pair of peripheral seals.

4. The rotary pump as in claim 3, wherein:

the ring-shaped side seal is disposed in the annular groove so that the side seal covers at least the circular gap between the pair of the peripheral seals, the first closure portion, and the second closure portion, thereby separating the low pressure space from the high pressure space.

5. The rotary pump as in claim 1, further comprising a ring-shaped rubber member disposed in the annular groove to push the ring-shaped side seal toward the axial surface of the rotating structure.

6. The rotary pump as in claim 5, wherein:

the ring-shaped side seal includes a supporting portion for supporting the ring-shaped rubber member thereon, the supporting portion being made thinner than a portion of the side seal which contacts the axial surface of the rotating structure.

7. The rotary pump as in claim 5, wherein:

a width of the annular groove is larger than a width of the ring-shaped side seal; and the side seal disposed in the annular groove is pushed toward the center hole of the casing by a pressure in the high pressure space.

8. A braking apparatus for use in an automobile vehicle, the braking apparatus including the rotary pump defined in claim 1 for generating a brake fluid pressure which is higher than a pressure generated in a master cylinder according to a braking force applied by a driver.

* * * * *